US011872456B1

(12) United States Patent
Estupina Blasco

(10) Patent No.: US 11,872,456 B1
(45) Date of Patent: Jan. 16, 2024

(54) BALL LAUNCHING NET POST SYSTEM

(71) Applicant: Sergi Andreu Estupina Blasco, Coral Gables, FL (US)

(72) Inventor: Sergi Andreu Estupina Blasco, Coral Gables, FL (US)

( * ) Notice: Subject to any disclaimer, the term of this patent is extended or adjusted under 35 U.S.C. 154(b) by 0 days.

(21) Appl. No.: 18/364,513

(22) Filed: Aug. 3, 2023

(51) Int. Cl.
*A63B 61/02* (2006.01)
*A63B 69/40* (2006.01)
*A63B 71/06* (2006.01)

(52) U.S. Cl.
CPC ..... *A63B 61/02* (2013.01); *A63B 69/40* (2013.01); *A63B 71/0622* (2013.01); *A63B 2071/0683* (2013.01); *A63B 2220/75* (2013.01); *A63B 2220/76* (2013.01)

(58) Field of Classification Search
CPC ..... A63B 61/02; A63B 69/40; A63B 71/0622
See application file for complete search history.

(56) References Cited

U.S. PATENT DOCUMENTS 5,160,131 A * 11/1992 Leon ..... A63B 69/409 124/56
5,590,876 A * 1/1997 Sejnowski ..... A63B 69/407 473/417
6,167,878 B1 * 1/2001 Nickerson ..... A63B 69/409 24/63
6,443,859 B1 * 9/2002 Markin ..... A63B 69/406 124/78
6,875,136 B2 * 4/2005 Leal ..... A63B 69/0002 124/16
7,294,071 B1 * 11/2007 Saumell ..... A63B 69/0053 473/418
8,678,955 B2 * 3/2014 McKendrick ..... A63B 69/0075 473/418
10,117,419 B2 * 11/2018 Hamill ..... A01K 15/027
10,118,078 B2 * 11/2018 Lewis ..... G09B 5/02
10,894,195 B2 * 1/2021 Pepe ..... A63B 63/004
11,027,185 B1 * 6/2021 LoDuca ..... A63B 69/0053
2003/0040381 A1 * 2/2003 Richings ..... A63B 69/406 473/569
2009/0120421 A1 * 5/2009 Chu ..... F41B 4/00 124/78
2021/0060391 A1 * 3/2021 Legg ..... A63B 24/0003

* cited by examiner

*Primary Examiner* — Eugene L Kim
*Assistant Examiner* — Christopher Glenn
(74) *Attorney, Agent, or Firm* — Ruben Alcoba, Esq.

(57) ABSTRACT

A net post system for padel tennis. The system comprises of a pair of post. Each post defines a lower ball launching aperture and a ball feeding aperture. A pair of ball chutes, each chute leads to the ball feeding aperture. A pair of controllers. Each controller connects to a power source. Each controller receives commands from a remote. A pair of housings. Each housing has a first servomotor that has a first wheel that spins counterclockwise, a second servomotor that has a second wheel that spins clockwise, wherein the first wheel and the second wheel are spatially separated so that a ball can be pushed into a space, and a third servomotor that controls a lever that is configured to push the ball within the space that leads to the ball launching aperture. And, a net that attaches to the pair of posts.

7 Claims, 6 Drawing Sheets

BALL LAUNCHING NET POST SYSTEM

TECHNICAL FIELD

The present invention pertains to a ball launching net post system for games that use a racquet or padel.

BACKGROUND

The present invention was created by an avid padel tennis player.

Padel tennis is a racquet sport that is similar to tennis that is played within a court that is a four-wall superstructure. It uses the same scoring system as tennis, yet the rules, strokes and techniques for playing are different. The main difference between tennis and padel tennis is that padel tennis has side walls and balls can be played of the side wails. Another difference is that when a bail is served, the ball must be served below waist level. Padel tennis uses stringless padels and uses balls that are similar to tennis balls, yet the balls are slightly smaller.

The court is a rectangular field that should measure 10 meters (32 ft 10 in) wide (back wall) and 20 meters (65 ft 7 in) long (side wall) (with a 0.5% tolerance). The rectangular field is surrounded by a four-wall superstructure. A net is hung at the middle of the playing field, the net supported by two side posts. The net divides the court into two playing sides. The rectangular field defines service lines that are placed 3 meters (9 ft 10 in) before the back walls of the superstructure. Lastly, there is a dividing line that separates the two playing sides, the net is hung above the dividing line.

The walls of the superstructure measure either three meters or four meters. Glass panels make up the back walls and service side walls (closest 2 side panels to back wails) and the glass panels measure four meters, while metal mesh panels occupy the middle side panels of the superstructure.

Padel tennis is a doubles game, two players occupy each side of the court. In a typical padel tennis game, three balls are used within the court during each game. Usually, a server and his or her partner carry the balls while playing.

The balls are typically held in the pockets of the players when the game is being played.

The inventor of the present invention has conceived a manner of eliminating the inconvenience of carrying the balls in the uniform of the players, while also providing the players with other advantages that will be described below.

The present invention is a ball launching net post system that will hold the balls during each game. A ball will be launched from each post of the net post system to a server prior to the commencement of each point of the game. Each post is designed to store balls during each game played. The players are instructed to place the balls into each post prior to the commencement of each point.

The net post system is an intelligent post system that uses a processor to control the launching of the balls upon a player's demand. The net post system is also designed to allow the players to receive information regarding the conditions of the court, the environment surrounding the court, and other information relevant to the playing field of the court. It is foreseen that the net post system of the present invention can be used to play other racquet or court games.

The net post system of the present invention will streamline the time to play each point and it will also allow the players to tactfully play each point.

SUMMARY

The present invention is directed to a net post system that is used to play padel tennis. It is foreseen that the net post system of the present invention can be used in other sports or games that have a net dividing the playing field.

The net post system comprises of a pair of post. Each post defines a lower ball launching aperture and a ball feeding aperture. A pair of ball chutes, each chute is attached to the ball feeding aperture. A pair of controllers. Each controller is connected to a power source. Each processor receives commands from a remote. A pair of housings. Each housing has a first servomotor that has a first wheel that spins counterclockwise, a second servomotor that has a second wheel that spins clockwise, wherein the first wheel and the second wheel are spatially separated so that a ball can be pushed into a space that separates the first wheel and the second wheel, and a third servomotor that controls a lever that is configured to push the ball within the space that leads to the ball launching aperture. And, a net that attaches to the pair of posts.

An object of the present invention is to provide a net post system that will streamline a padel tennis game by eliminating the normal time that it takes to play between each point of the game.

Another object of the present invention is to provide a padel tennis player with a device that will inform the player of the environment surrounding the court being played on.

Yet another object of the present invention is to provide a padel tennis player with a device that will inform the player of the court conditions of the court that is being played on.

Still another object of the present invention is to provide a padel tennis player with a device that will launch him a ball that will be used commence each point of the game upon the players remote demand for the ball.

Yet still another object of the present invention is to provide a padel tennis player with a device that will allow the player not to have to carry balls within the player's uniform during each point played.

BRIEF DESCRIPTION OF THE DRAWINGS

These and other features, aspects, and advantages of the present invention will become better understood with regards to the following description, appended claims, and drawings where:

DESCRIPTION

Figure 1:
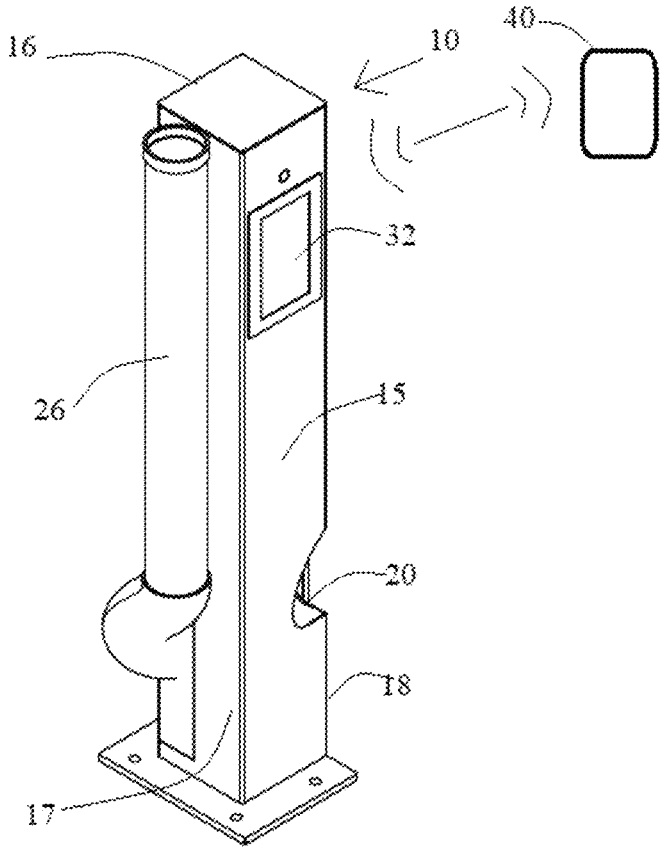
FIG. 1 is a perspective view of one of the posts of the present invention.
Figure 2:
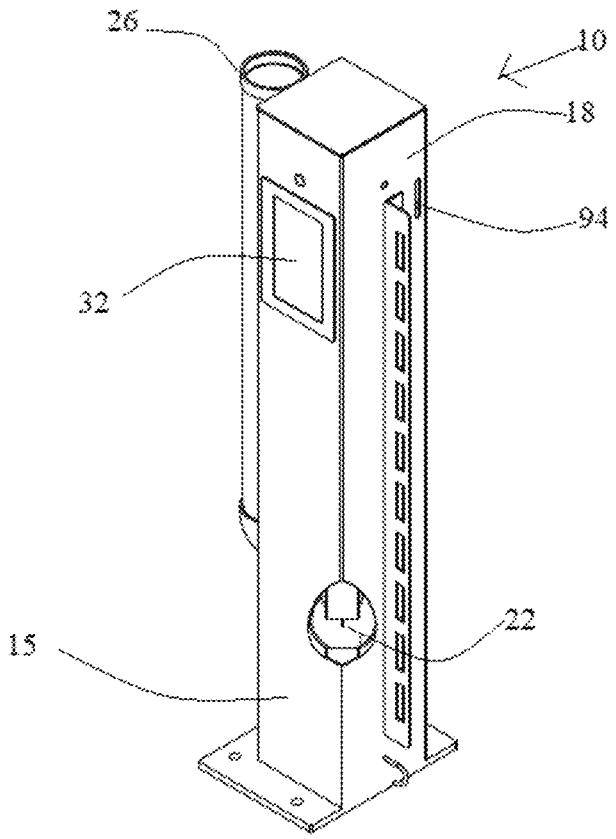
FIG. 2 is another perspective view of the post of the present invention.
Figure 3:
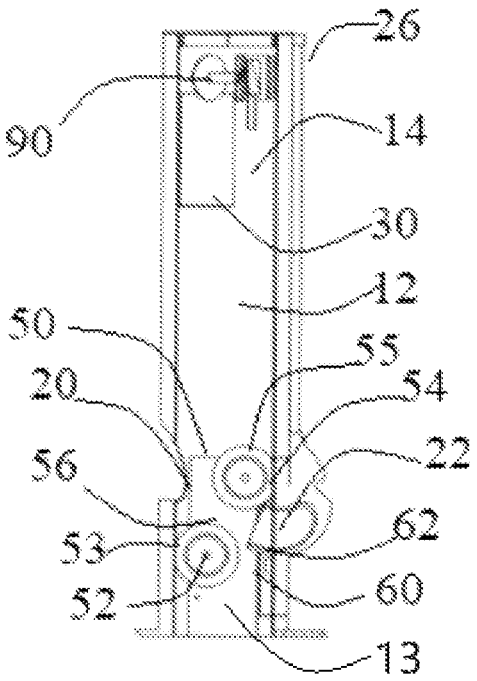
FIG. 3 is an isometric view of the post of the present invention.
Figure 4:
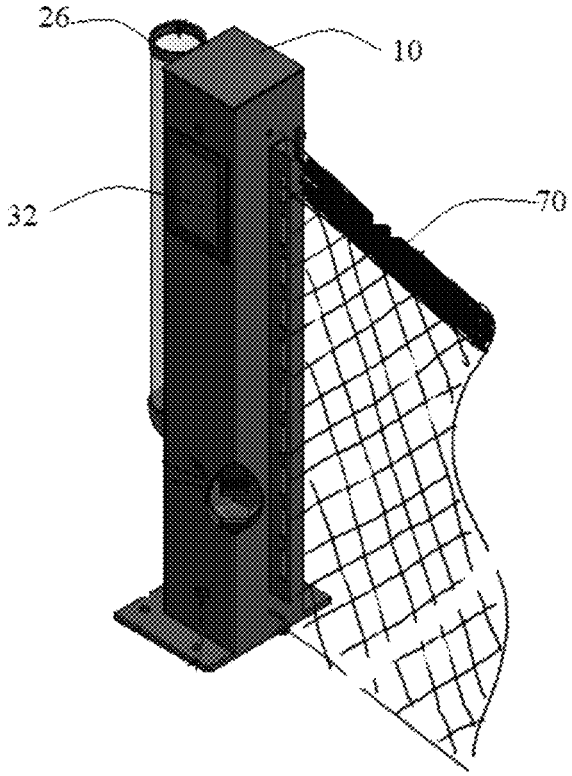
FIG. 4 is a perspective view of the present invention showing a net attached to the post.
Figure 5:
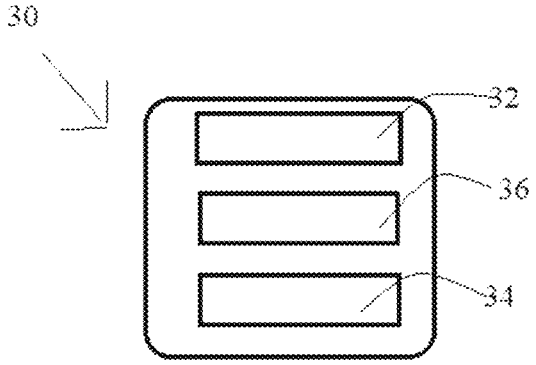
FIG. 5 is a diagram of the elements within the controller of the present invention.
Figure 6:
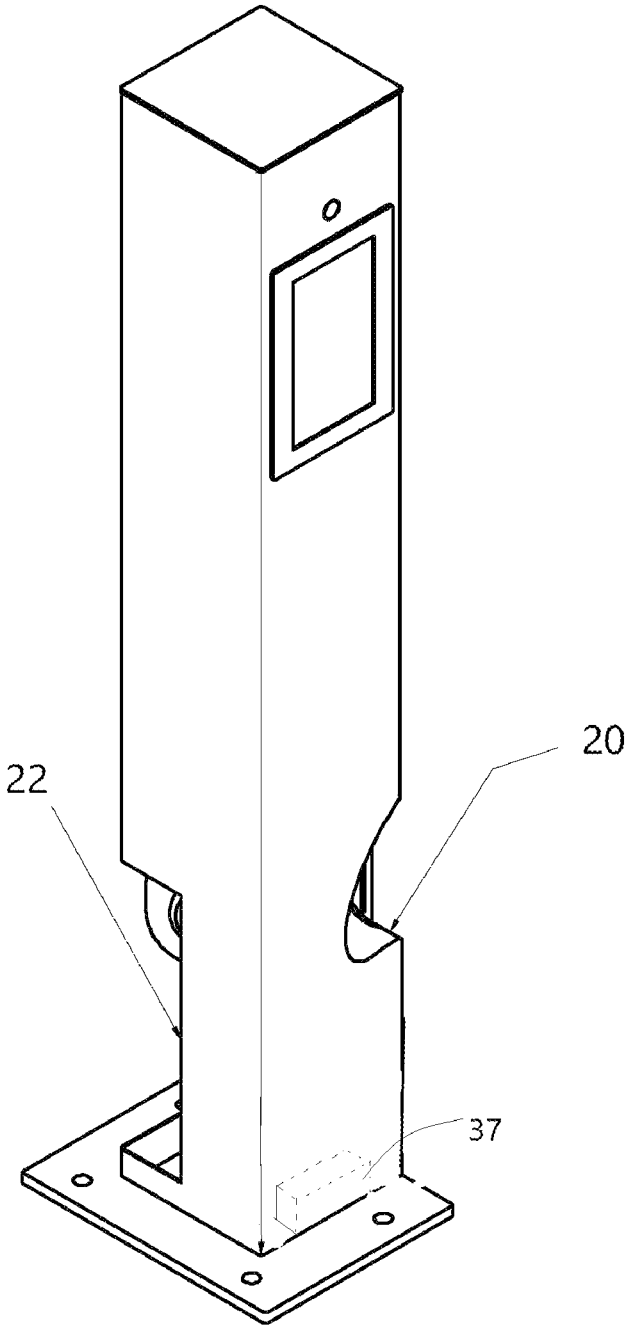
FIG. 6 is a perspective view of the post of the present invention.

As seen in FIGS. 1-5, the present invention is a ball launching net post system.

The ball launching net post system comprises a pair of posts 10, each post 10 of the pair of posts 10 has an inner chamber 12, a lower section 13, an upper section 14, a front side 15, a rear side 16, a left lateral side 17, and a right lateral side 18, the pair of posts 10 are configured to be secured to a court so that each post 10 is placed at a mid-lateral section of the court, each post 10 is configured to launch a ball to a player upon the player remotely requesting a ball from a controller 30 that is placed within each post 10, each post 10 defines a lower ball launching aperture 20 that is positioned between the front side 15 and the right lateral side 18, each post 10 defines a ball feeding aperture 22 that is defined at the left lateral side 17 of the lower section 13 of each of the pair of posts 10. A pair of ball chutes 26, each chute 26 is attached to the left lateral side 17 of each post 10 that defines the ball feeding aperture 22, each ball chute 26 is configured to feed the ball into the ball feeding aperture 22. A pair of controllers 30, each controller 30 of the pair of controllers 30 has a display 32, a transceiver 34, a processor 36 that is configured to measure the humidity of the court, the wind conditions affecting each court, and the weather conditions that will affect each court, each controller 30 is connected to a power source 37 that is provided by the court, each controller 30 is placed on the upper section 14 of the inner chamber 12 and the display 32 of each controller 30 is placed on the front side 15 of each post 10, each controller 30 is configured to receive commands from a remote 40 that will allow the player to request the release of the ball from each post 10. A pair of housings 50, each housing 50 of the pair of housings 50 houses has a first servomotor 52 that has a first wheel 53 that spins counterclockwise, a second servomotor 54 that has a second wheel 55 that spins clockwise, wherein the first wheel 53 and the second wheel 55 are spatially separated so that a ball can be pushed into a space 56 that separates the first wheel 53 and the second wheel 55, and a third servomotor 60 that controls a lever 62 that is configured to push the ball within the space 56 between the first wheel 53 and the second wheel 55, each housing is placed on a lower section 14 of the inner chamber 12 of each post 10 so that the ball that is placed within the space 56 that is between the first wheel 53 and the second wheel 55 can be launched through the lower ball launching aperture 20. And, a net 70 that is attached to the pair of posts 10.

In an embodiment of the present invention, the net post system comprises a tension mechanism 90 that is within the upper section 14 of each post 10 and the tension mechanism 90 attaches to the net 70, the tension mechanism 90 is configured to operatively connect to each controller 30 so that the net 70 is maintained at a playing height by the controller 30.

In another embodiment of the present invention, the ball launching net post system comprises a sensor 94 that is configured to measure the height of the net 70, the sensor 94 is operative connected to the controller 30, the sensor 94 is positioned on an upper section 14 of the right lateral side 18 of each post 10.

In a further embodiment of the present invention, the ball launching net post system comprises the remote 40 that operatively connects to the pair of controllers 30, the remote 40 is configured to send commands to the pair of controllers 30 and to receive information from the pair of controllers 30.

In a preferred embodiment, the remote 40 will be a smart watch.

An advantage of the present invention is that it provides a net post system that streamlines a padel tennis game by eliminating the normal time that it takes to play between each point of the game.

Another advantage of the present invention is that it provides a padel tennis player with a device that informs the player of the environment surrounding the court being played on.

Yet another advantage of the present invention is that it provides a padel tennis player with a device that informs the player of the court conditions of the court that is being played on.

Still another advantage of the present invention is that it provides a padel tennis player with a device that launches the tennis player a ball that is used commence each point of the game, upon the players remote demand for the ball.

Yet still another advantage of the present invention is that it provides a padel tennis player with a device that allows the player not to have to carry balls within the player's uniform during each point played.

The embodiments of the ball launching net post system described herein are exemplary and numerous modifications, combinations, variations, and rearrangements can be readily envisioned to achieve an equivalent result, all of which are intended to be embraced within the scope of the appended claims. Further, nothing in the above-provided discussions of the ball launching net post system should be construed as limiting the invention to an embodiment or a combination of embodiments. The scope of the invention is defined by the description, drawings, and claims.

What is claimed is:

1. A ball launching net post system, the ball launching net post system comprises:

a pair of posts, each post of the pair of posts has an inner chamber, a lower section, an upper section, a front side, a rear side, a left lateral side, and a right lateral side skies, the pair of posts are configured to be secured to a court so that each post is placed at a mid-lateral section of the court, each post is configured to launch a ball to a player upon the player remotely requesting a ball from a controller that is placed within each post, each post defines a lower ball launching aperture that is positioned between the front side and the right lateral side, each post defines a ball feeding aperture that is defined at the left lateral side of the lower section of each of the pair of posts;

a pair of ball chutes, each chute is attached to the left lateral side of each post that defines the ball feeding aperture, each ball chute is configured to feed the ball into the ball feeding aperture;

a pair of controllers, each controller of the pair of controllers has a display, a transceiver, a processor that is configured to measure the humidity of the court, the wind conditions affecting the court, and the weather conditions that affect each court, each controller is connected to a power source that is provided by the court, each controller is placed on the upper section of the inner chamber and the display of each controller is placed on the front side of each post, each controller is configured to receive commands from a remote that will allow the player to request the release of the ball from each post;

a pair of housings, each housing of the pair of housings houses has a first servomotor that has a first wheel that spins counterclockwise, a second servomotor that has a second wheel that spins clockwise, wherein the first wheel and the second wheel are spatially separated so that a ball can be pushed into a space that separates the first wheel and the second wheel, and a third servomotor that controls a lever that is configured to push the ball within the space between the first wheel and the second wheel, each housing is placed on a lower section of the inner chamber of each post so that the ball that is placed within the space that is between the first wheel and the second wheel can be launched through the lower ball launching aperture; and a net that is attached to the pair of posts.

2. The ball launching net post system of claim 1, the ball launching net post system comprises a tension mechanism that is within the upper section of each post and the tension mechanism attaches to the net, the tension mechanism is configured to operatively connect to each controller so that the net is maintained at a playing height by the controller.

3. The ball launching net post system of claim 2, the ball launching net post system comprises a sensor that is configured to measure the height of the net, the sensor is operative connected to the controller, the sensor is positioned on an upper section of the right lateral side of each post.

4. The ball launching net post system of claim 3, the ball launching net post system comprises the remote that operatively connects to the pair of controllers.

5. The ball launching net post system of claim 4, wherein the remote is a smart watch.

6. The ball launching net post system of claim 1, the ball launching net post system comprises the remote that operatively connects to the pair of controllers.

7. The ball launching net post system of claim 6, wherein the remote is a smart watch.

* * * * *